US007779729B2

(12) United States Patent
Pella et al.

(10) Patent No.: US 7,779,729 B2
(45) Date of Patent: Aug. 24, 2010

(54) DRUM LID REMOVAL TOOL

(75) Inventors: Bernard M. Pella, Martinez, GA (US); Philip D. Smith, North Augusta, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 0 days.

(21) Appl. No.: 12/152,556

(22) Filed: May 15, 2008

(65) Prior Publication Data

US 2009/0282951 A1 Nov. 19, 2009

(51) Int. Cl.
*B67B 7/16* (2006.01)

(52) U.S. Cl. ..... 81/3.57

(58) Field of Classification Search ..... 81/3.57, 81/3.55; 29/244, 245, 267
See application file for complete search history.

(56) References Cited

U.S. PATENT DOCUMENTS 3,872,745 A * 3/1975 Garza et al. ..... 81/3.55
D244,575 S * 6/1977 Endres et al. ..... D8/40
D254,834 S * 4/1980 Madsen et al. ..... D8/18
4,234,988 A * 11/1980 Ross et al. ..... 7/151
4,492,132 A 1/1985 Obey
4,658,455 A * 4/1987 Skillern ..... 7/105
4,747,173 A * 5/1988 Marceau ..... 7/156
D304,992 S * 12/1989 Matthies ..... D8/40
D308,322 S * 6/1990 Borden ..... D8/40
4,967,436 A * 11/1990 Russell ..... 7/156
4,974,441 A 12/1990 Keeney et al.
5,069,090 A * 12/1991 Clark ..... 81/3.09
5,241,719 A 9/1993 Memmelaar
D359,220 S * 6/1995 Vinar ..... D8/105
5,476,023 A 12/1995 Calandro
5,778,472 A * 7/1998 Lang ..... 7/156
5,931,059 A * 8/1999 Hammer ..... 81/3.57
5,971,190 A 10/1999 Mannino
6,058,808 A * 5/2000 Williams et al. ..... 81/3.55
6,578,223 B1 * 6/2003 Link et al.

* cited by examiner

*Primary Examiner*—David B Thomas
(74) *Attorney, Agent, or Firm*—J. Bennett Mullinax, LLC

(57) ABSTRACT

A tool for removing the lid of a metal drum wherein the lid is clamped over the drum rim without protruding edges, the tool having an elongated handle with a blade carried by an angularly positioned holder affixed to the midsection of the handle, the blade being of selected width to slice between lid lip and the drum rim and, when the blade is so positioned, upward motion of the blade handle will cause the blade to pry the lip from the rim and allow the lid to be removed.

15 Claims, 2 Drawing Sheets

DRUM LID REMOVAL TOOL

FEDERALLY SPONSORED RESEARCH

The U.S. Government has rights in this invention pursuant to contract number DE-AC O9-96SR18500 between the U.S. Department of Energy and Washington Savannah River Company LLC.

FIELD OF THE INVENTION

This invention relates to a tool for removing the lids of open head metal drums wherein the lid forms a clamping ring that clamps to the drum rim leaving a very small gap between the lid and drum rim with no protuberances.

BACKGROUND OF THE INVENTION

In the shipping industry there are two types of metal drums in general use. These are open head drums and closed head, the closed head being those with bung holes for removal of the drum contents through the side of the drum. The present invention is directed to open head drums and for these there are generally two types of drum rings for securing the lid to the drum. These two types are one-piece and two-piece rings and the present invention applies to one-piece rings.

The mechanism used to seal the one-piece lid on a metal drum is different from the method used for paint cans or plastic buckets. The sealing mechanism of the metal drum includes a rolled surface having a circular cross-section at the top of the drum to form the rim around the opening. The drum lid contains a circumferential groove of half circle cross-section shaped identically to the rolled rim that mates over the entire surface of the rim. In some instances a drum lid may include gasket material or a sealing gel to form a more secure seal between the drum rim and the groove in the lid. The lid, however, is held in place on the drum by forcing the lid groove over the drum rim in a clamping fit. In other words, this drum ring type of closure uses a half circle channel or groove that clamps over the transition area between the rolled rim and the edge of the drum lid. This causes an extremely close tolerance, e.g., a gap of less than 0.025 inches between the rolled rim and the outer edge of the drum lid. Thus, there is no surface, ridge, or protruding edge to grasp to remove the lid from the drum. Most often the drum lids are removed with a hammer and chisel and, as a result, the lid and drum rim are scarred or dented limiting the ability to reuse the drum or the lid. Accordingly, it is one object of the present invention to provide a drum removal tool which minimizes the damage to the lid or rim of an open head drum.

In the prior art there are many tools for removing the lids from cans, buckets and drums and, in general, for opening various types of containers; but, these invariably are for containers with a protruding edge or recessed groove that can be gripped. One problem, as mentioned, is to readily open the container so that the lid is not destroyed even when there is a protruding edge on the lid. For example, U.S. Pat. No. 5,241,719 which issued on Sep. 7, 1993 describes a lid removal tool for removing sealed covers from large cans or buckets and which employs a round hammer head with a handle and a hook located on the handle near the hammer so that the hook can grip a protruding edge of the lid or cover and pry the edge away as the handle is rotated upwardly. Another lid removal tool is shown in U.S. Pat. No. 5,476,023 that issued on Dec. 19, 1995 and which describes a device for removing lids from containers by positioning the apparatus on the lid. The apparatus has a leg extension that hooks under the rim of the lid so that the hook will pull the rim away from the container as the apparatus is rotated. Other representative lid removal tools are shown in U.S. Pat. Des. 308,322 and U.S. Pat. No. 4,492,132. However, all of these prior art devices are used where there is a protruding tab or edge that is readily gripped. Accordingly, it is an object of the present invention to provide a tool for opening drums that have no protruding lid edges so that minimum damage is done to the lid or drum.

In U.S. Pat. No. 4,974,441 which issued on Dec. 4, 1990, a sharp edged tool is used to slide between the crimped flange and the flat surface of a metal duct. The crimped flange or tab edge is a flat surface area with a small gap between the tab and the duct to slide the tool edge therebetween. The edge of metal crimped tab is straight and the tool wedges the sharp edge between the duct surface and the edge of the crimped tab until the bend of the crimp is reached and then the crimped tab is brought away from the flat surface. Here, the tab is designed to be bent and removed from installation. Thus, it is another object of the present invention to provide a tool to remove drum lids which do not have segments designed to be bent away and which can be employed at different positions around the circumference of a drum.

The foregoing and other objects of the present invention will be apparent from the description below.

SUMMARY OF THE INVENTION

In one aspect the present invention is a drum removal tool for drums having lids with a snap-fit lip that clamps over the rolled rim of the drum without a protruding edge comprising an elongated handle having a hand-grip section, a lever section, and a mid-section therebetween; a blade holder extending outwardly from said midsection at an angle in the range from about 64° to about 72° from the longitudinal axis of the handle; a blade having a knife-like tip or edge, said blade being detachably affixed to the free-end of said holder and extending towards the handle, said blade being at an angle from the range of about 34° to about 42° from said holder, the width of said blade being selected to conform to the curvature of the lid, the tip of the blade being spaced apart from the handle; a lever member at the lever end of the handle, said member being adapted to contact the lid as a pivot point, whereby when the tip of the blade is inserted between the lip of the lid of a drum and the rim of the drum, upward manual movement of the handle grip section will move the lid away from the rim as the handle pivots around the lever member when it contacts the lid thus allowing the lid to be removed.

In another aspect, the lever member serving as the pivot point may be formed in the lever end of the tool as an integral part thereof or it can be a resilient, non-skid surface attached to the lever end where the lever end contacts the drum lid.

In still another aspect, the blade holder angle is preferably about 68° from the longitudinal axis of the handle and the blade is an angle of about 38° from the holder.

In yet another aspect, the blade may have a width in the range of about 1" to about 1½". The blade width preferably is determined by the diameter of the drum lid or its radius or curvature so that the blade will slice into the small cavity between the lip of the lid and the surface of the rolled edge of the drum rim without cutting into either the rim or lip. Furthermore, the blade may be curved to match the curvature of the drum rim.

DESCRIPTION OF THE DRAWINGS

The drawings which are appended hereto and made a part of this disclosure are presented by way of examples of preferred embodiments and are not limiting on the scope of the invention. In the drawings.

DETAILED DESCRIPTION

Figure 1A:
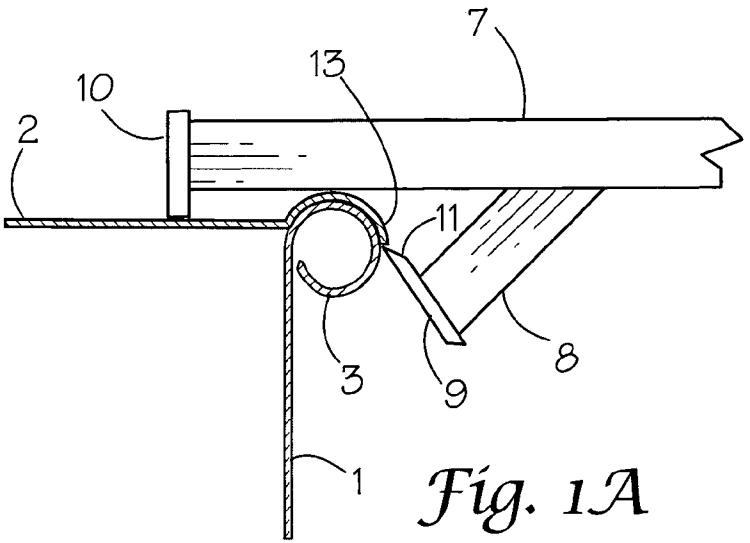
FIG. 1A is a blown-up view in partial section of the area of FIG. 1 showing the removal tool of the present invention with the blade in position below the lip of a lid to be removed.
Figure 1B:
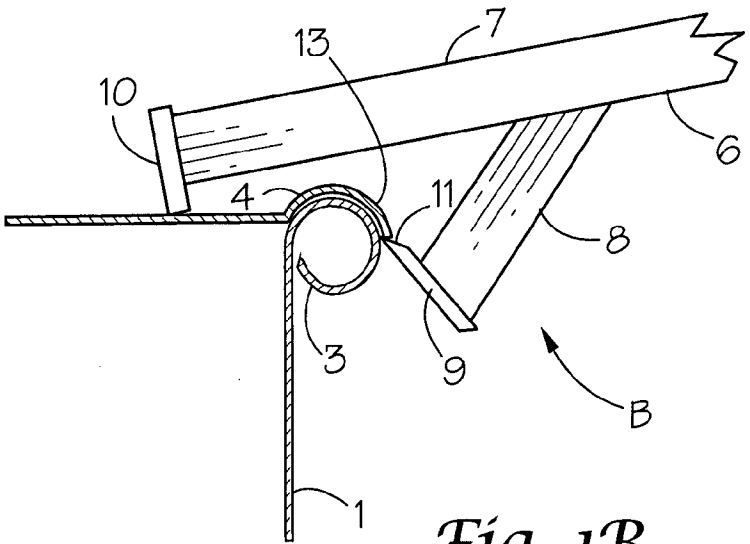
FIG. 1B is the tool as shown in FIG. 1A as the handle of the tool has been rotated upwardly so that the blade begins to lift the rim of the lid and lip away from the rolled rim of the drum so they become separated.
Figure 1:
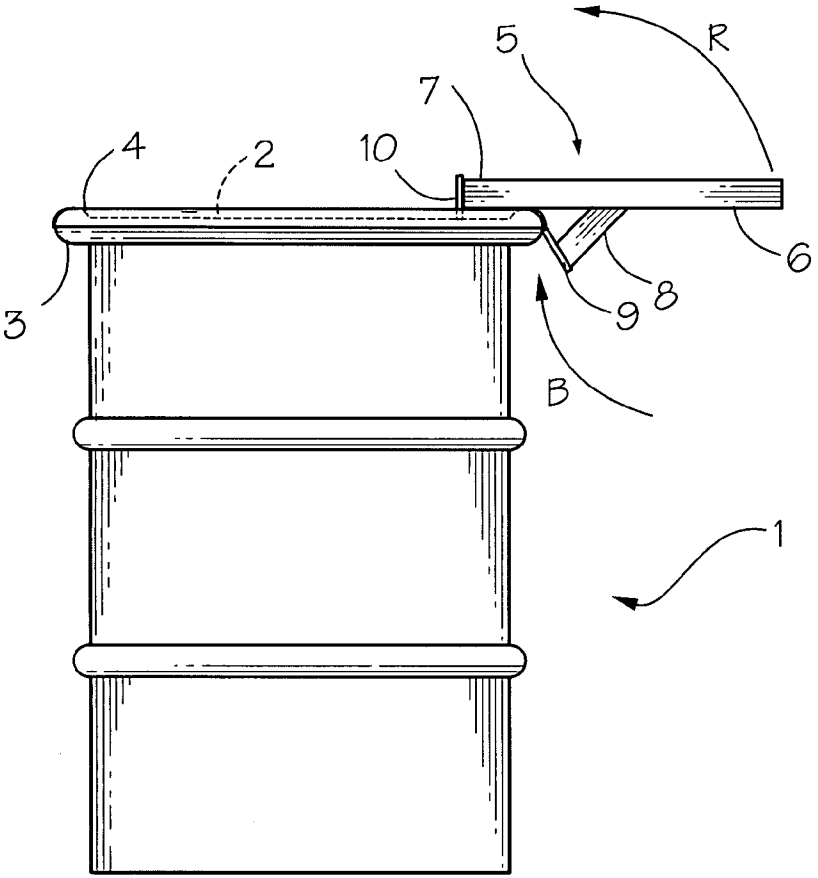
FIG. 1 is an elevation view showing a drum with a removal tool, which is one embodiment of the present invention, in place ready to remove the lid of the drum.

Referring first to FIG. 1, the drum lid removal tool 5 has been developed to fill the need to open a metal drum 1 having a clamping ring lid 2. The sealing means is a circular rolled drum surface or rim 3 at the opening of the top of the drum. The drum lid 2 contains an identically shaped half circle groove 4 that mates over the entire surface of the drum rolled edge 3. The lid is held in place on the drum by forcibly clamping the grooved drum ring 4 over rim 3. In other words, the drum ring uses the half circle channel or groove 4 to clamp over the transition area between the drum rolled edge and the edge of the drum lid causing an extremely close tolerance or a gap less than 0.025 inches between the drum rolled edge and the drum lid. In FIG. 1A, this is the space between rolled edge 3 and grooved lip 13 of the lid 2. This extremely close gap tolerance is unlike surfaces or ridges or protruding edges that may be grasped to remove lids from other types of containers.

Figure 3:
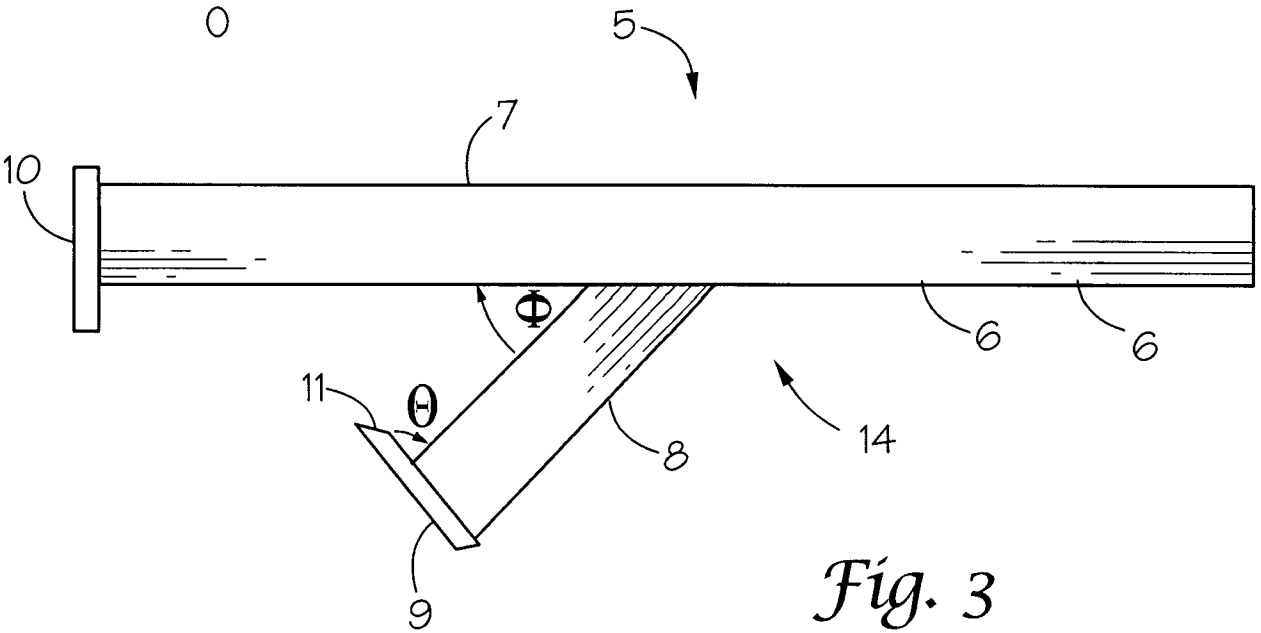
FIG. 3 is a side view of the tool of the present invention showing the angles at which the blade holder and blade are positioned.

In FIG. 1B the drum lid removal tool 5 uses a knife edge 11 to slide or slice between the extremely small gap or void between the drum rolled edge and the drum lid. This is done forcibly using a prying motion in the direction of arrow "B" to expand the clearance between the drum rolled edge 3 and the drum lid lip 13. This motion separates the drum lid from the drum top edge releasing the tension of the clamping action of the lid lip against the drum rolled edge thus permitting removal of the drum lid. This operation may need to be repeated at intervals around the circumference of a drum when a sealant or gasket has been applied to the mating surfaces of the grooved lid lip and the rolled drum edge. The angle of the knife edge and the angle relative to the drum lid edge are critical parameters for the use of the drum lid removal tool. If the angle is too steep the knife edge cuts into the upper rolled edge of the drum. If the angle is too shallow the knife edge rides over the transition area of the drum lid and a drum top rolled edge. Looking now at FIG. 3, these critical angles can be seen. The angle between the blade holder 8 and the handle 5 is designated as angle Φ (Phi) and this angle has been discovered to preferably be about 68° and may be in the range of from about 64° to about 72°. Likewise, the angle between the blade holder and the blade is designated as angle Θ (Theta). This angle has been discovered as preferably being about 38° but may vary from 34° to 42°. Also in FIG. 3 lever member 10 is shown attached at the end of lever section 7. The lever member 10 as shown in its upright position in FIG. 1 provides the pivot point about which the handle is rotated in the direction R which provides leverage for pulling the lid lip 13 away from the rolled edge 3 of the drum. The member 10 can be in the form of a plate as shown or may be of another shape or the pivot function may be performed with a non-skid or cushioning surface at the lever end.

Figure 2:
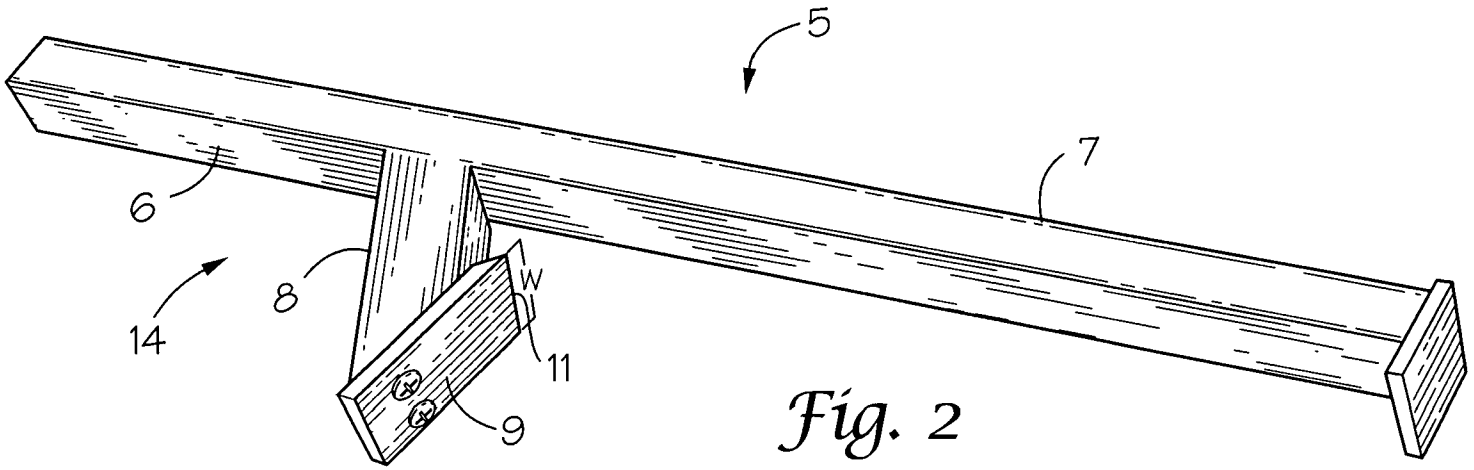
FIG. 2 shows the removal tool of the present invention in a perspective view showing the screws securing the blade to the holder.

In FIG. 2 the lid removal tool 5 is shown in perspective with the lever section 7 forming one end section and the handle grip 6 forming the other with a midsection therebetween from which the blade holder 8 is attached. The blade 9 is detachably held and secured to the plate holder by flat head screws 12. These blades may be interchanged to be compatible with drums of different diameters. For a typical 55 gallon drum a blade width, W, of 1½" is preferable. For most large diameter drums, the blade may be straight as a circumferential segment of a large diameter lid for a short distance may be approximated by a straight line but where the diameter of the drum is smaller and the curvature is greater the blade may be curved to match the curvature of the drum rim, that is, the blade edge can be shaped with a surface that approximates the rim curvature so that the width, w, is not a straight line but a circular segment.

Various modifications may be made in and to the foregoing described embodiment without departing from the spirit and scope of the invention. For example, the handle section 6 may be rounded to provide a more comfortable hand grip, the lever member 10 may be of different configuration to provide a pivot point, and the blade may be detachably affixed to the blade holder by a different mechanism. Accordingly, the invention is only limited by the scope of the claims below.

We claim:

1. A drum lid removal tool for drums having lids with a snap fit lip that clamps over the rim of a drum without a protruding edge comprising:

a) an elongated handle having a hand-gripped section, a lever section, and a midsection therebetween, wherein said lever section between said midsection and a lever member is uniform in shape without any projections extending from said lever section;

b) a blade holder extending outwardly from said midsection at an angle in the range of 64° to 72° from the longitudinal axis of the handle, wherein said blade holder has a surface extending from said handle to a free end of said blade holder that faces said lever section of said handle;

c) a blade having a knife-like tip, said blade being detachably affixed to the free end of said holder and extending toward the handle, wherein said blade has an inner surface that has a portion that abuts the free end of said blade holder and has a portion that extends from said portion that abuts said free end of said blade holder to said knife-like tip that is at an angle in the range of from about 34° to about 42° from said surface of said blade holder, the tip of the blade being spaced apart from the handle; and, d) said lever member at the lever end of the handle, wherein said lever member abuts a terminal end of said lever section such that said lever section is completely located between said lever member and said midsection, said member having a lid contact section having a lower terminal end located farthest from the handle that is completely on the same side of the handle as the blade holder that is completely planar, wherein the lid contact section is on the same side of the handle as the blade holder and is positioned whereby when the tip of the blade is inserted between the lip of the lid and, the rim of the drum, upward movement of the handle grip section will cause the lever member to contact the drum lid and be a pivot point about which the handle will rotate forcing the blade to move the lip away from the rim allowing the lid to be removed from the rim.

2. The tool of claim 1 wherein the angle of the blade holder is about 68° and the angle of the blade is at about 38°.

3. The tool of claim 1 wherein the blade width is in the range of 1" to 1.5".

4. The tool of claim 1 wherein the blade is curved to approximate the curvature of the drum rim.

5. The tool of claim 1 wherein the lever member is a plate at the lever end of the handle, said plate being at right angles to the handle, said plate having an extension section on the same side of the handle as the blade holder whereby when the tip of the blade is inserted between the lip of the lid of the drum and the rim of the drum upward movement of the handle grip section will move the lever plate down onto the lid to form a pivot point so that the continued upward movement of the handle grip will move the lip away from the rim allowing the lid to be removed from the drum.

6. A drum lid removal tool for drums having lids with a snap fit lip that clamps over the rim of a drum without a protruding edge comprising:

a) an elongated handle having a hand-gripped section, a lever section, and a midsection therebetween, wherein said lever section between said midsection and a lever member is uniform in shape without any projections extending from said lever section;

b) a blade holder extending outwardly from said midsection at an angle in the range of 64° to 72° from the longitudinal axis of the handle; wherein said blade holder has a surface extending from said handle to a free end of said blade holder that faces said lever section of said handle;

c) a blade having a knife-like tip, said blade extending toward the handle, wherein said blade has an inner surface that has a portion that abuts the free end of said blade holder and has a portion that extends from said portion that abuts said free end of said blade holder to said knife-like tip that is at an angle in the range of from about 34° to about 42° from said surface of said blade holder, the tip of the blade being spaced apart from the handle; and, d) said lever member at the lever end of the handle, wherein said lever member abuts a terminal end of said lever section such that said lever section is completely located between said lever member and said midsection, said member having a lid contact section having a lower terminal end located farthest from the handle that is completely on the same side of the handle as the blade holder that is completely planar, wherein the lid contact section is on the same side of the handle as the blade holder and is positioned whereby when the tip of the blade is inserted between the lip of the lid and, the rim of the drum, upward movement of the handle grip section will cause the lever member to contact the drum lid and be a pivot point about which the handle will rotate forcing the blade to move the lip away from the rim allowing the lid to be removed from the rim, wherein said lever member has an upper terminal end that is oppositely disposed from said lower terminal end of said lever member, wherein a side surface of said lever member forms an entire terminal end of the drum lid removal tool that is oppositely disposed from a surface of said lever member that abuts the terminal end of said lever section, wherein said side surface of said lever member is completely planar and flat and continuous from an edge shared with said lower terminal end of said lever member to an edge shared with said upper terminal end of said lever member.

7. The tool of claim 6 wherein the angle of the blade holder is about 68° and the angle of the blade is at about 38°.

8. The tool of claim 6 wherein the blade width is in the range of 1" to 1.5".

9. The tool of claim 6 wherein the blade is curved to approximate the curvature of the drum rim.

10. The tool of claim 6 wherein the lever member is a plate at the lever end of the handle, said plate being at right angles to the handle, said plate having an extension section on the same side of the handle as the blade holder whereby when the tip of the blade is inserted between the lip of the lid of the drum and the rim of the drum upward movement of the handle grip section will move the lever plate down onto the lid to form a pivot point so that the continued upward movement of the handle grip will move the lip away from the rim allowing the lid to be removed from the drum.

11. A drum lid removal tool for drums having lids with a snap fit lip that clamps over the rim of a drum without a protruding edge comprising:

a) an elongated handle having a hand-gripped section, a lever section, and a midsection therebetween;

b) a blade holder extending outwardly from said midsection at an angle in the range of 64° to 72° from the longitudinal axis of the handle, wherein said blade holder has a surface extending from said handle to a free end of said blade holder that faces said lever section of said handle;

c) a blade having a knife-like tip, said blade extending toward the handle, wherein said blade has an inner surface that has a portion that abuts the free end of said blade holder and has a portion that extends from said portion that abuts said free end of said blade holder to said knife-like tip that is at an angle in the range of from about 34° to about 42° from said surface of said blade holder, the tip of the blade being spaced apart from the handle; and, d) a lever member at the lever end of the handle, wherein said lever member abuts a terminal end of said lever section such that said lever section is completely located between said lever member and said midsection, said member having a lid contact section having a lower terminal end located farthest from the handle that is completely on the same side of the handle as the blade holder that is completely planar, wherein the lid contact section is on the same side of the handle as the blade holder and is positioned whereby when the tip of the blade is inserted between the lip of the lid and, the rim of the drum, upward movement of the handle grip section will cause the lever member to contact the drum lid and be a pivot point about which the handle will rotate forcing the blade to move the lip away from the rim allowing the lid to be removed from the rim, wherein said lever member has an upper terminal end that is oppositely disposed from said lower terminal end of said lever member, wherein a side surface of said lever member forms an entire terminal end of the drum lid removal tool that is oppositely disposed from a surface of said lever member that abuts the terminal end of said lever section, wherein said side surface of said lever member is completely planar and flat and continuous from an edge shared with said lower terminal end of said lever member to an edge shared with said upper terminal end of said lever member.

12. The tool of claim 11 wherein the angle of the blade holder is about 68° and the angle of the blade is at about 38°.

13. The tool of claim 11 wherein the blade width is in the range of 1" to 1.5".

14. The tool of claim 11 wherein the blade is curved to approximate the curvature of the drum rim.

15. The tool of claim 11 wherein the lever member is a plate at the lever end of the handle, said plate being at right angles to the handle, said plate having an extension section on the same side of the handle as the blade holder whereby when the tip of the blade is inserted between the lip of the lid of the drum and the rim of the drum upward movement of the handle grip section will move the lever plate down onto the lid to form a pivot point so that the continued upward movement of the handle grip will move the lip away from the rim allowing the lid to be removed from the drum.

* * * * *